United States Patent [19]

Garrett

[11] Patent Number: 4,841,867

[45] Date of Patent: Jun. 27, 1989

[54] DISCARDING SABOT PROJECTILE

[75] Inventor: Harold E. Garrett, Santa Anna, Calif.

[73] Assignee: Ford Aerospace Corporation, Newport Beach, Calif.

[21] Appl. No.: 138,256

[22] Filed: Dec. 28, 1987

[51] Int. Cl.[4] ..... F42B 13/16

[52] U.S. Cl. ..... 102/520; 102/523

[58] Field of Search ..... 102/520–523

[56] References Cited

U.S. PATENT DOCUMENTS

| | | | |
|---|---|---|---|
| 2,775,943 | 1/1957 | Ekseigian | 102/523 |
| 3,745,926 | 7/1973 | Metz et al. | 102/523 |
| 3,795,196 | 3/1974 | Hillenbrand | 102/522 |
| 4,043,269 | 8/1977 | Ambrasini | 102/522 |
| 4,187,783 | 2/1980 | Campoli et al. . | |
| 4,249,466 | 2/1981 | Rossmann et al. . | |
| 4,296,687 | 10/1981 | Garrett | 102/523 |
| 4,459,894 | 7/1984 | Bunch . | |
| 4,709,638 | 12/1987 | Broden et al. | 102/522 |

FOREIGN PATENT DOCUMENTS

| | | | |
|---|---|---|---|
| 104587 | 4/1984 | European Pat. Off. | 102/520 |

*Primary Examiner*—Harold J. Tudor

*Attorney, Agent, or Firm*—Peter D. McDermott; Roger L. May

[57] ABSTRACT

A discarding sabot projectile comprises:

a subcaliber projectile;

a discarding sabot means for providing a full caliber carrier for the projectile;

a discarding sabot base abutting a rearwardly facing surface of the aft end of the projectile, which base is free of direct positive coupling to the projectile;

sabot/projectile coupling means for direct connection of the discarding sabot means to the projectile to prevent axially forward displacement of the projectile relative the sabot; and sabot/base coupling means for direct and positive connection of the discarding sabot means to the sabot base, locking the projectile into position within the cavity defined by the discarding sabot means and sabot base.

9 Claims, 2 Drawing Sheets

DISCARDING SABOT PROJECTILE

BACKGROUND OF THE INVENTION

1. Field of the Invention

The present invention is directed to a subcaliber projectile and discarding sabot assembly, referred to generally in the art as a sabot projectile. More specifically, the invention is directed to a sabot Projectile wherein the projectile body is locked within the discarding sabot and a discarding sabot base, the discarding sabot base being free of direct, positive coupling to the projectile.

2. Background Art

It is well known in the art to employ a subcaliber heavy metal projectile with a discarding sabot formed typically of light plastic to support the subcaliber projectile during launch. This allows the projectile to be fired from a large bore gun barrel, whereby the propelling force acts over a larger lateral area than that presented by the projectile alone. In this way the projectile undergoes greater acceleration and achieves higher velocity.

Typically, a sabot/projectile assembly further comprises a sabot base which is coupled to the aft end of the projectile. It is this sabot base which normally presents the rearwardly facing lateral surface to the propulsive forces generated during firing of the projectile. The base then transmits the forward acceleration forces to the projectile and main sabot body. Once the projectile leaves the gun barrel, however, both the main sabot body and the sabot base are discarded, that is, they separate from the projectile, whereby the aerodynamic projectile is free to continue traveling without the sabot and base.

Known designs for the sabot base, of which that shown in FIGS. 1 and 2 of the attached drawings is typical, generally are relatively complicated. In particular, known designs for the sabot base typically include discardable petals to hold the heavy metal projectile to the sabot base. Discardable petals often are used to hold the projectile in place relative the sabot base during injection molding of the main sabot body around the projectile in a mold-in-place process. In U.S. Pat. No. 4,459,894 to Bunch, for example, such a mold-in-place process is disclosed. Specifically, the projectile therein is used as the core pin of a forming mold wherein the plastic sabot is molded directly onto the projectile. A sabot base, therein referred to as "a pusher plug 16" is seen to comprise axially forwardly extending discardable petals (shown without reference numeral) at the aft end of the projectile. Alignment between the projectile, referred to therein as "core 14" and the other components is said to be achieved by, among other ways, a force fit between the projectile and the recess defined in part by the discardable petals. Existing sabot base designs employing such discardable petals are not only disadvantageously complicated, both in design and in manufacture, but in addition, partly as a result of such complexity, entail design, manufacturing and quality control costs which could advantageously be reduced.

Another disclosure of a sabot projectile employing such discardable petals is found in U.S. Pat. No. 4,249,466 to Rossmann et al, wherein a projectile 1 is shown mounted in a bore 8 of a sabot base 10. Discardable petals (shown without reference numeral) are seen to extend forwardly from the sabot base and to provide radially inwardly extending ridges seated in corresponding radially outwardly opening recesses in the aft portion of the projectile. It is an object of the present invention to provide an improved discarding sabot projectile, particularly to provide a discarding sabot projectile wherein the sabot base is of less complex design. These and other objects of the invention will be better understood in the light of the following detailed disclosure of the invention.

SUMMARY OF THE INVENTION

According to the present invention, a discarding sabot projectile comprises:

a subcaliber projectile having a generally cylindrical mid-section, a generally aerodynamic forward section and an aft section;

a discarding sabot means (referred to in some instances herein as the sabot) for providing a full caliber carrier for the projectile, the discarding sabot means surrounding the projectile circumferentially and extending longitudinally over at least a major portion of the aforesaid mid-section thereof;

a discarding sabot base axially aligned with the projectile and disposed aft thereof abutting a rearwardly facing surface of the aft section of the projectile, the sabot base being free of direct, positive coupling to the projectile;

sabot/projectile coupling means for direct connection of the sabot to the projectile to prevent axially forward displacement of the projectile relative the sabot; and sabot/base coupling means for direct, positive communication of the sabot to the base to prevent axial displacement of the base relative the sabot and to lock the projectile in position within them.

Those skilled in the art will achieve a fuller understanding of the invention and of the objects and advantages thereof from the following more detailed description taken in connection with the accompanying drawings.

DETAILED DESCRIPTION OF THE PREFERRED EMBODIMENTS

Figure 1:
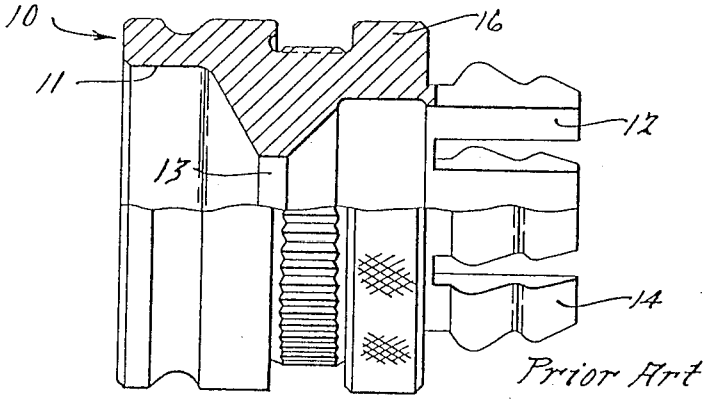
Prior Art FIG. 1.
FIG. 1 is a side view, partially in cross-section, of a typical prior art sabot base.
Figure 2:
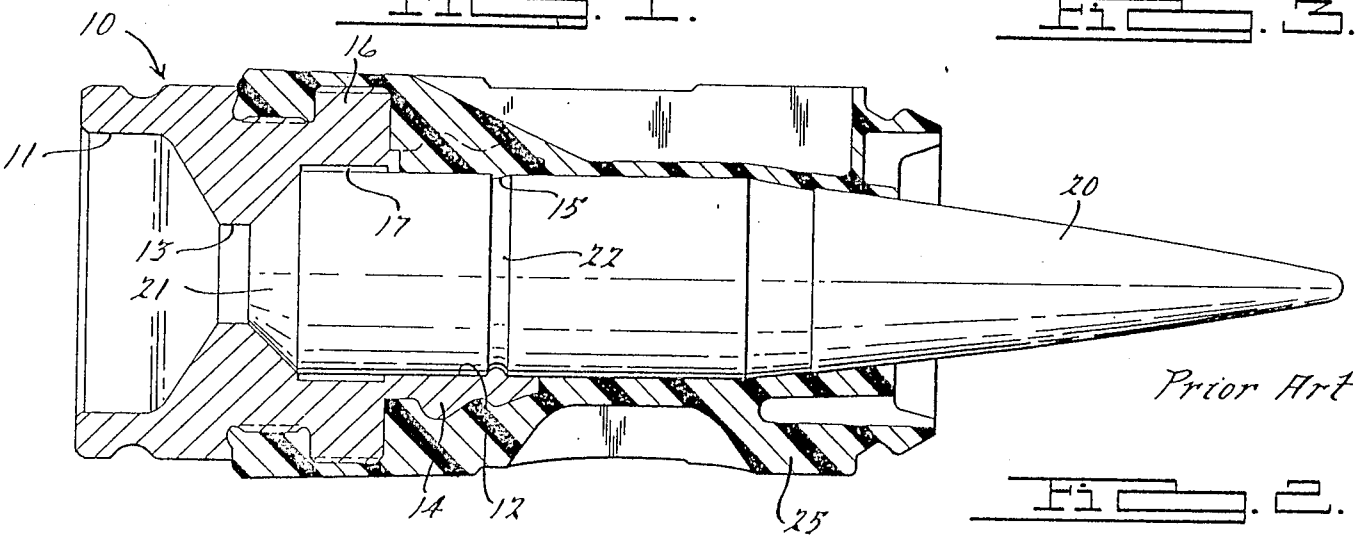
Prior Art FIG. 2.
FIG. 2 is a cross-sectional side view of a sabot projectile incorporating the sabot base of FIG. 1.

Referring first to FIGS. 1 and 2, a sabot base and a sabot projectile incorporating same according to a typical known design are illustrated. The base 10 is seen to comprise a rearwardly opening recess 11 and a forwardly opening recess 12, typically communicating through orifice 13 for purposes of allowing hot propulsion gases generated during firing of the projectile to ignite a trace (not shown) carried at the aft end 21 of projectile 20. It can be seen that forwardly opening recess 12 is formed in part by discardable petals 14 extending axially forwardly from the main body of the sabot base. A discarding sabot 25 surrounds the projectile 20 circumferentially and extends longitudinally over a mid-section of the projectile and a portion of the aerodynamic forward end of the projectile. A rearwardly extending flange at the aft end of the sabot engages the sabot base. It can be seen that the base is directly, positively coupled to the projectile. That is, the base is directly coupled to the projectile in that the two are coupled by their own intermeshed surface configuration, rather than through the function of an intermediate component. The base is positively coupled to the projectile in that the two effectively lock each other in position relative one another. Specifically, it can be seen that the discardable petals 14 span an outwardly opening groove 22 extending circumferentially around the projectile. Each of the petals presents a ridge 15 tightly received in groove 22. Typically, ridges 15 are formed by applying sufficient force radially inwardly against the radially outer surface of the discardable petals opposite groove 22, whereby the material of petal 14 is forced into groove 22. The petals obviously for this purpose must be fabricated of a suitably ductile material, such as an aluminum alloy or the like. In firing such a sabot projectile, deformation of forward portion 16 of the base into annular void 17 between the base and the sabot causes fracture and separation of the petals 14 from the main body of the sabot base. This function, however, requires that the components of the sabot projectile be fabricated to relatively close tolerances, which disadvantageously introduces both cost and complexity into the fabrication of the sabot projectile.

Figure 3:
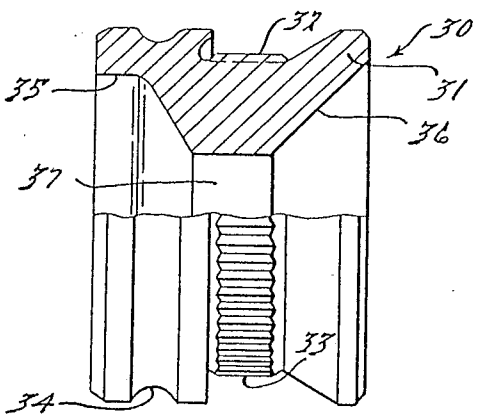
FIG. 3 is a side view, partially in cross-section, of a sabot base according to a preferred embodiment of the invention.
Figure 4:
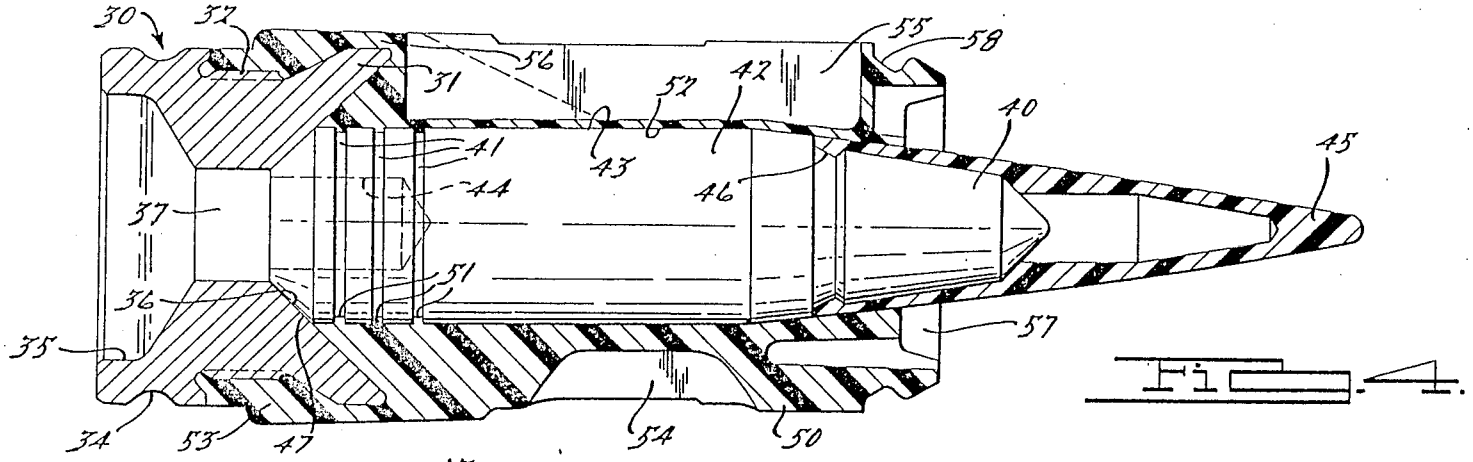
FIG. 4 is a cross-sectional side view of a sabot projectile according to a preferred embodiment of the invention, incorporating the sabot base of FIG. 3.

Referring now to FIGS. 3 and 4, a sabot projectile according to a preferred embodiment of the invention is seen to comprise a sabot base 30, projectile 40 and discarding sabot 50. Sabot base 30 comprises no discardable petals and, in fact, comprises no coupling means for direct positive coupling to the projectile. Rather, the sabot projectile as will now be described in detail, is seen to comprise sabot/projectile coupling means for direct connection of the sabot to the projectile to prevent axially forward displacement of the projectile relative the sabot, and sabot/base coupling means for direct, positive connection of the sabot to the base to prevent axial displacement of the base relative the sabot and to lock the projectile in position within the chamber defined by the sabot and sabot base.

In the preferred embodiment of FIG. 4, the sabot/-projectile coupling means for direct connection of the sabot to the projectile is seen to comprise a set of three radially outwardly facing retention grooves 41 extending circumferentially around the projectile at the aft end of tubularly shaped mid-section 42. A set of corresponding radially inwardly extending retention ridges 51 extend circumferentially around an inner surface 52 which is adjacent to and has substantial, preferably complete, surface contact with the exterior surface 43 of the cylindrical mid-section 42 of the projectile. Retention ridges 51 are received by retention grooves 41 to provide a direct, positive connection of the sabot to the projectile. That is, the connection is direct in that that sabot is in surface contact with the projectile and the connection is positive in that the ridge-in-groove meshing of the surface of the sabot with the surface of the projectile locks the projectile against axial displacement relative the sabot. It is within the ability of those skilled in the art to select the number, depth, position and configuration of retention grooves 41 and corresponding retention ridges 51. It will be understood in view of the present disclosure that these must be designed to provide sufficiently secure engagement of the sabot to the projectile to hold these components together against the forward shock of loading the projectile into a gun chamber and against like forces to be experienced by the assembly. For the same reason, it will be understood that the thickness of the sabot flange 53 over the radially outer surface of the forward portion 31 of the base, that is area 56 of the sabot, must be sufficient to withstand forces and shocks to be experienced during handling, storage and loading of the ammunition round.

The sabot/base coupling means of the sabot projectile of FIG. 4 is seen to comprise a forward portion 31 of the base extending forwardly and radially outwardly form a mid-portion 32 of the base. The mid-portion 32 is seen to have a radial dimension less than that of forward portion 31. The sabot/base coupling means further comprises a rearwardly extending aft flange 53 of the sabot embracing forward portion 31 of the base and at least a portion of mid-portion 32 of the base. It can be seen in FIG. 4 that such sabot/base coupling means locks the base in position, i.e., prevents axial displacement of the base relative the sabot. The sabot/base coupling means is direct in that the sabot itself embraces the base. It also is a positive connection since it locks the axial position of the two components relative one another. It also will be appreciated that the sabot/base coupling means locks the projectile in position within the cavity defined by the base and sabot.

In the preferred embodiment of FIG. 3, mid-portion 32 of the sabot base has an anti-rotational slip surface 33 engaged by aft flange 53 of the sabot. The anti-rotational slip surface 33 is seen to comprise a series of longitudinal grooves closely spaced circumferentially around mid-portion 32 on the exterior surface of the base.

Sabot base 30 is seen to further comprise radially outward opening recess 34 adapted to be engaged by the casing of an ammunition round. Rearwardly opening bell mouth 35 of the base is adapted to receive the acceleration forces generated during firing of the ammunition round. Axially extending orifice 37 provides communication of the pressure and temperature conditions during firing to radially centered, rearwardly opening recess 44 (shown in phantom) in the aft section of the projectile 40. Such recess 44 could, for example, house a trace charge ignitible by such temperature and pressure conditions during the firing of the round.

The sabot 50 is seen to comprise various optional features known to the skilled of the art such as, for example, lightening recess 54. The particular number, placement and configuration of such recesses are determined according to design principles well known to those skilled in the art. Circumferentially narrow separation groove 55 is seen to extend longitudinally in the sabot. Again, it is within the ability of those skilled in the art to design the size, number and configuration of such separation grooves. Cap attachment groove 58 is provided to receive an aerodynamic nose cap (not shown) such as are known in the art, for example, as shown in U.S. Pat. No. 4,249,466, the disclosure of which is herein incorporated by reference. Forward bell mouth 57 is provided to reduce the mass of the sabot. The projectile 40 is seen to be provided with an aerodynamic nose cone 45 held to the projectile by ridge-in-groove connection 46.

It will be appreciated that although there is direct connection of the base 30 to the projectile 40, there is no positive connection therebetween. Rather, the base merely abuts the aft surface of projectile 40. More specifically, according to the preferred embodiment shown in FIG. 4, the sabot base further comprises a forwardly opening frustroconical recess 36 concentric with the sabot base and with the projectile. The projectile aft section has a rearwardly tapering frustroconical extension 47 nested in the frustroconical recess 36 of the sabot base. In this way, proper lateral and axial positioning of the projectile relative the sabot base is provided. Such proper positioning of the projectile relative the base is employed, for example, where the sabot is to be injection molded around the base/projectile assembly as a single unitary piece. Such mold-in-place techniques are well known to the skilled of the art and include, for example, the teachings of U.S. Pat. No. 4,459,894 to Bunch, mentioned above, the disclosure of which is incorporated herein by reference. The projectile would be positioned in the frustroconical recess of the base within a forming mold and the sabot material, typically plastic, injected into the forming mold around the projectile and around at least a portion of the base.

Alternative embodiments of the invention include those wherein the sabot is provided as a multi-segment assembly. Specifically, for example, the sabot could be provided in multiple longitudinal sections assembled around the projectile, held together in assembly by an obturator band provided as a separate component. Such multi-segment sabots are known to the skilled of the art, as disclosed in U.S. Pat No. 4,187,783 to Campoli et al and in U.S. Pat. No. 4,296,687 to Garrett, the disclosures of which is herein incorporated by reference. According to such embodiments, it would not be essential that the sabot base provide the frustroconical nest for the projectile, although it would not be inconsistent with the invention to do so.

Figure 5:
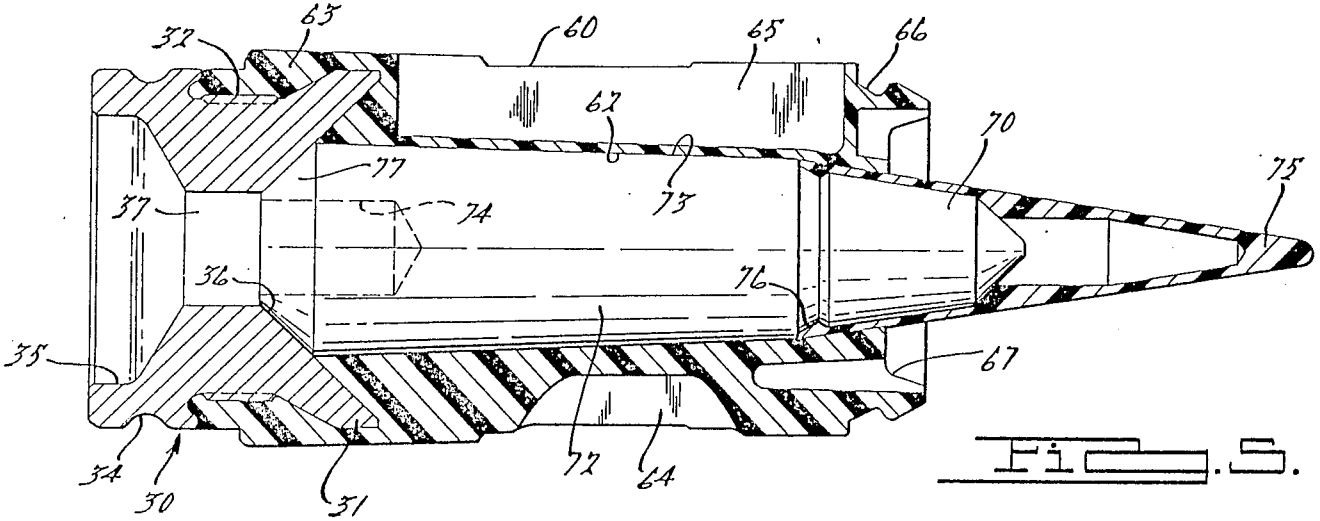
FIG. 5 is a cross-sectional side view of a sabot projectile according to a second preferred embodiment of the invention, incorporating the sabot base of FIG. 3.

Referring to the alternative preferred embodiment of FIG. 5, it can be seen that the base 30 is the same as that of FIGS. 3 and 4. The sabot projectile of FIG. 5 further comprises sabot 60 and projectile 70. It can be seen that many features of the sabot and projectile are the same as those in the embodiment of FIG. 4. Thus, sabot 60 comprises a rearwardly extending aft flange 63 embracing forward portion 31 and at least a portion of the mid-portion 32 of the base. Accordingly, just as in the embodiment of FIG. 4, the sabot projectile of FIG. 5 comprises a sabot/base coupling means in which the connection between the sabot and the sabot base is both direct in that the connection is made by immediate contact of the two components, and positive in that the sabot base is fixed against axial movement relative the sabot. The sabot further provides radially outward opening groove 66 to receive an aerodynamic cap for the sabot projectile assembly. Projectile nose cone 75 is seen to be connected to the projectile at ridge-in-groove means 76. The sabot also has separation grooves 65, lightening recesses 64 and forwardly opening bell mouth 67 corresponding to such features as described above in connection with the embodiment of FIG. 4.

The sabot projectile of FIG. 5 comprises a sabot/-projectile coupling means which differs from that of the embodiment of FIG. 4. Specifically, it does not employ ridge-in-groove means to couple the sabot to the projectile. Rather, in the embodiment of FIG. 5 the cylindrically shaped mid-section 72 of the projectile is forwardly tapered. That is, the diameter of the projectile diminishes as one progresses axially forwardly along the mid-section. Thus, surface 73 of the mid-section is generally frustroconical. The inside surface 62 of the sabot tightly jackets at least a substantial portion of the tapered exterior surface of the projectile. Thus, the connection between the sabot and the projectile in the embodiment of FIG. 5 is direct in that the connection is formed by immediate contact of the sabot with the projectile, but is not positive in that the projectile is not locked against axially rearward movement relative the sabot. The projectile is fixed by the frustroconical connection against forward movement relative the sabot and, of course, the projectile is fixed in position in the sabot/projectile assembly in that it is trapped within the cavity defined by the sabot and the sabot base.

As in the embodiment of FIG. 4, the sabot, as shown, could comprise a unitary, one-piece body member surrounding the projectile and, accordingly, would be adapted to fabrication by a mold-in-place process such as described above. To facilitate such molding operation, the projectile 70 of FIG. 5 comprises an aft section having a rearwardly tapered frustroconical extension 77 nesting within the frustroconical recess 36 of the sabot base. The projectile is seen also to comprise a rearwardly opening recess 74 (shown in phantom) suitable for receiving a trace charge, which charge could be ignited by communication of pressure and temperature conditions through aperture 37 in the base during firing of the sabot projectile.

In addition to the various fabrication methods mentioned above in connection with certain of the components of the sabot projectile of the invention, additional, alternative fabrication methods are well known and will be apparent to the skilled of the art in view of the present disclosure. Suitable materials for each of the components also are well known and will be apparent in view of the present disclosure and include, for example, various plastics for the discarding sabot, front cap and nose cone and light metals for the sabot base.

It will be apparent from the foregoing that the present invention provides various significant advantages over prior known designs. Among the most significant of these advantages is the reduction in the weight of the sabot base and the reduction in the amount of material (bar stock) necessary to fabricate the base, since the forwardly extending discardable petals are eliminated. Also, the sabot base of the present invention, unlike prior known sabot base designs such as that of FIG. 1, can be readily formed by chipless manufacturing techniques, thereby providing significant cost savings. For the same reason, the number of machining operations is greatly reduced and the shear strength of the base can be improved. Additionally, the base discard function is significantly simplified and improved, leading to improved performance quality. Another quality improvement stems from the opportunity to avoid reliance on radially inward compression of the base to fracture the connection of the discardable petals to the main body of the base. Such radially inward compression must occur in the gun barrel and avoidance of this function in the sabot base of the present invention results in more compatible interaction or interface of the base with the gun barrel. Additional features and advantages of the invention will be apparent to those skilled in the art in view of this disclosure. In addition, various modifications and variations of the invention will be apparent to those skilled in the various arts to which this invention pertains in view of the present disclosure. Such modifications and variations are within the scope of this invention as defined by the following claims.

I claim:

1. A discarding sabot projectile comprising:

a subcaliber projectile having a generally cylindrically shaped mid-section, a generally aerodynamic forward section and an aft section having a rearwardly tapering frustro-conical extension;

a unitary discarding sabot means for providing a full caliber carrier for said projectile, said discarding sabot means surrounding said projectible circumferentially, extending longitudinally over at least a major portion of said mid-section thereof and incorporating a rotating band unitary with said discarding sabot means;

a discarding sabot base axially aligned with said projectile and disposed aft thereof, comprising a forwardly opening frustro-conical recess concentric with said sabot base and wiht said projectile, in which opening nests said rearwardly tapering frusto-conical extension of said aft section of said projectile, said sabot base being free of direct positive coupling to said projectile, and having no cylindrical recess receiving a cylindrical portion of said projectile;

sabot/projectile coupling means for direct connection of said discarding sabot means to said projectile to prevent axially forward displacement of said projectile relative said sabot; and sabot/base coupling means for direct positive connection of said discarding sabot means to said sabot base to prevent axial displacement of said sabot base relative said discarding sabot means and to lock said projectible in position within them.

2. The discarding sabot projectile according to claim 1, wherein said sabot/projectile coupling means comprises at least one radially outwardly facing retention groove extending circumferentially around said projectile and a radially inwardly extending retention ridge extending circumferentially around an inside surface of said discarding sabot means adjacent said projectile, said retention ridge received by said retention groove.

3. The discarding sabot projectile according to claim 2, comprising three said retention grooves and three corresponding retention ridges.

4. The discarding sabot projectile according to claim 1, wherein said sabot/projectile coupling means comprises a forwardly tapered exterior surface of said mid-section of said projectile and an inner surface of said discarding sabot means tightly jacketing at least a substantial portion of said tapered exterior surface of said projectile.

5. The discarding sabot projectile according to claim 1, wherein said sabot/base coupling means comprises:

a forward portion of said sabot base extending forwardly and radially outwardly from an axial mid-portion of said sabot base having a radial dimension less than that of said forward portion; and a rearwardly extending aft flange of said discarding sabot means engaging said forward portion of said sabot base and at least a portion of said mid-portion of said sabgt base.

6. The discarding sabot projectile according to claim 5, wherein said mid-portion of said sabot base has an anti-rotational slip surface engaged by said aft flange of said discarding sabot means, whereby said sabot base and said discarding sabot means are fixed against rotational displacement relative one another.

7. The discarding sabot projectle according to claim 6, wherein said anti-rotational slip surface comprises a series of longitudinal grooves closely spaced circumferentially around said mid-portion of said sabot base.

8. The discarding sabot projectile according to claim 1, wherein said discarding sabot means comprises a unitary, one-piece body member circumferentially surrounding said projectile.

9. The discarding sabot projectile according to claim 1, wherein said sabot base is the product of a chipless manufacturing process.

* * * * *